US007431310B2

(12) United States Patent
Redor et al.

(10) Patent No.: US 7,431,310 B2
(45) Date of Patent: Oct. 7, 2008

(54) DEVICE FOR MOUNTING COMPONENTS OF A SAFETY BINDING ON A SKI

(75) Inventors: Denis Redor, Saint Julien de Ratz (FR); Michel Mercier, Voiron (FR); Pierre Gignoux, Coublevie (FR); Christian Allary, Saint Pierre de Chartreuse (FR); Michel Echevin, Meylan (FR)

(73) Assignee: Skis Rossignol, Motrans (FR)

( * ) Notice: Subject to any disclaimer, the term of this patent is extended or adjusted under 35 U.S.C. 154(b) by 348 days.

(21) Appl. No.: 11/271,948

(22) Filed: Nov. 14, 2005

(65) Prior Publication Data

US 2006/0103112 A1 May 18, 2006

(30) Foreign Application Priority Data

Nov. 12, 2004 (FR) ..... 04 52603

(51) Int. Cl.
*A63C 5/07* (2006.01)
*A63C 5/075* (2006.01)

(52) U.S. Cl. ..... 280/11.14; 280/11.15; 280/607; 280/618

(58) Field of Classification Search ..... 280/601, 280/602, 607, 11.14, 617, 618, 620, 633, 280/634, 636
See application file for complete search history.

(56) References Cited

U.S. PATENT DOCUMENTS 5,135,250 A 8/1992 Abondance et al.
5,480,175 A * 1/1996 Astier et al. ..... 280/607
5,647,605 A * 7/1997 Arduin ..... 280/602
6,065,895 A * 5/2000 Lehner et al. ..... 403/105
6,193,262 B1 * 2/2001 Silva ..... 280/607
6,315,318 B1 * 11/2001 Caron et al. ..... 280/617
6,631,918 B2 * 10/2003 Silva ..... 280/607
6,786,501 B2 * 9/2004 Derisoud et al. ..... 280/623
6,814,367 B2 * 11/2004 Mercier et al. ..... 280/613
7,284,767 B2 * 10/2007 Himmetsberger et al. ... 280/617
7,296,818 B2 * 11/2007 Krumbeck et al. ..... 280/607
2002/0047250 A1 * 4/2002 Luitz et al. ..... 280/607

(Continued)

FOREIGN PATENT DOCUMENTS

AT 411 735 B 10/2003

(Continued)

*Primary Examiner*—Christopher Ellis
*Assistant Examiner*—Vaughn T Coolman
(74) *Attorney, Agent, or Firm*—Browdy and Neimark, P.L.L.C.

(57) ABSTRACT

A device (1) for mounting the components of a safety binding on a ski, comprising:

a longitudinal strip (2) that has, on either side, a guide (10) with a break in its middle;

two units (5, 6) each intended to accommodate one of the components of the safety binding, each unit being mounted on said strip (2) with the possibility of adjusting its longitudinal position by sliding in said guides (10);

a plurality of points (20-23) for mounting the longitudinal strip (2) on the upper surface of the ski, some of these points (20, 23) allowing longitudinal displacement, relative to the upper surface of the ski, of the area of the longitudinal strip in which they are located;

a base (4, 7) intended to come into contact with the upper surface of the ski and on which said longitudinal strip (2) rests, said base extending over a width in excess of that of said longitudinal strip.

13 Claims, 4 Drawing Sheets

U.S. PATENT DOCUMENTS

| | | | |
|---|---|---|---|
| 2002/0105167 | A1 | 8/2002 | Mercier et al. |
| 2003/0001363 | A1 | 1/2003 | Battisella et al. |

FOREIGN PATENT DOCUMENTS

| | | | |
|---|---|---|---|
| EP | 0 409 749 | A1 | 1/1991 |
| EP | 1 181 960 | A1 | 2/2002 |
| FR | 2 664 823 | A1 | 1/1992 |
| FR | 2 815 546 | A1 | 4/2002 |
| FR | 2 820 335 | | 8/2002 |
| WO | WO 93/12845 | A | 7/1993 |

* cited by examiner

DEVICE FOR MOUNTING COMPONENTS OF A SAFETY BINDING ON A SKI

FIELD OF THE INVENTION

The present invention relates to the field of snow boardsports and, more particularly, Alpine skiing. More precisely, it concerns a device for mounting components of a safety binding on a ski, namely the heel piece and the toe piece.

PRIOR ART

Generally speaking, very many solutions have already been proposed to make it possible to mount the components of the binding not directly on the upper surface of the ski but on an intermediate device. This type of intermediate device may be used for several reasons. In the case of skis that are intended for hire, it is useful if the bindings have a longitudinal adjustment facility and the use of an intermediate device makes it possible to avoid having to drill many holes in the upper surface of the ski. Such an adjustment facility is described, in particular, in document FR 2 820 335.

Intermediate devices also make it possible to raise the binding and make it easier to roll from one edge to the other as described in document EP 0 409 749.

From a mechanical point of view, these intermediate devices are also used to ensure loose linkage, i.e. to limit the effect of the stiffness of the sole of the boot on the behaviour of the ski.

The loose linkage phenomenon is relatively complex because there is a need to ensure good anchorage of the components of the binding without modifying the inherent stiffness of the board excessively. This is why solutions have been suggested whereby a plate of viscoelastic material is placed underneath the platform as illustrated in document FR 2 664 823.

In other solutions, especially that described in document FR 809 634, part of the platform may be made mobile relative to the upper surface of the ski by being mounted with the ability to slide relative to a fixed point attached to the upper surface of the ski.

SUMMARY OF THE INVENTION

The invention therefore relates to a device for mounting the components of a safety binding on a ski.

In accordance with the invention, this device comprises:

- A longitudinal strip that has, on either side, a guide with a break in its middle;
- two units each intended to accommodate one of the components of the safety binding, each unit being mounted on said strip with the possibility of adjusting its longitudinal position by sliding in said guides;
- a plurality of points for mounting the longitudinal strip on the upper surface of the ski, some of these points allowing longitudinal displacement, relative to the upper surface of the ski, of the area of the longitudinal strip in which they are located;
- A base intended to come into contact with the upper surface of the ski and on which said longitudinal strip rests, said base extending over a width in excess of that of said longitudinal strip.

In this way, it is very easy to adjust the position of the toe piece and the heel piece by altering the position of each unit. This adjustment is especially useful for skis that are hired out because these require adaptation of the two components of the binding depending on the customer's shoe size.

Each unit can be fitted or, if applicable, replaced thanks to the break in the guide in the middle of the strip which makes it possible to detach each unit from the strip.

It should be noted that movement of each of these units makes it possible to access the points for mounting the strip on the ski so that, if necessary, the manner in which this strip is attached to the ski can be modified.

These mounting points are configured to allow relative displacement of one part of the strip relative to the upper surface of the ski as the latter bends, depending on the behaviour which one wishes the board to have.

The relative displacement of the strip with respect to the ski can be dampened by the presence of the base placed between the strip and the upper surface of the ski.

In practice, the guide on each side of the strip can be produced in different ways. The guide can be formed by grooves made on each lateral side of the strip. Alternatively, a rail placed on the lateral side of the strip makes it possible, together with the upper surface of the board, to define a guide into which a part of each movable unit fits.

Similarly, the distinctive strip can be produced in different ways. The strip can be of one-piece construction, i.e. consist of a single part that extends over the entire length of the area where the binding is mounted. Alternatively, this strip can be formed from two separate pieces, namely a front piece and a rear piece that are separated where there is the break in the guide. In other words, in this variant, each unit is mounted on a specific portion of the strip and there is naturally a break in the guide at the point where the two portions of the strip are separated. This break in the guide may extend over a distance that is greater than the distance that separates the two portions of the strip in order to enable insertion of the units that accommodate the components of the binding.

Additionally, in order not to increase the general stiffness of the ski equipped with the device according to the invention excessively, the platform may advantageously have a number of crosswise recesses in its lower surface in its middle area intended to reduce its flexural stiffness.

In practice, the longitudinal position of each unit can be adjusted by various means, especially by cooperation of a mechanism on the unit and notched features on the longitudinal strip.

Advantageously and in practice, to allow loose linkage of the platform relative to the ski, some of the mounting points can be formed by longitudinally elongated holes through which components having a smaller cross-section pass. In this way, the area of the strip that has these holes can then move relative to the component that passes through it.

Advantageously and in practice, one can make provision to arrange mounting points at four distinct longitudinal levels with various configurations for those points that have a certain degree of mobility. It is possible to fix the strip immovably on the central points whereas the extreme points are free to make a translational movement relative to the board. In another version, the front of the strip can be immovably secured with respect to the ski whereas the rear part has the ability to move.

As already stated, the base placed between the strip and the ski can be made of an elastic or even a viscoelastic material so that it is deformed as the ski bends and, in certain situations, part of the kinetic energy associated with this movement is dissipated by these elements.

This base may have various geometries. It can be of one-piece construction and consist of a plate that extends over the entire length of the strip. It may also be separated into two parts, either longitudinally or crosswise or in both these directions, so as to form independent pads placed underneath the front and the rear of the ski on either side.

BRIEF DESCRIPTION OF THE DRAWINGS

In order that the way in which the invention is implemented and its resulting advantages may more readily be understood, the following description is given, merely by way of example, reference being made to the accompanying drawings.

DESCRIPTION OF THE PREFERRED EMBODIMENTS

Figure 1:
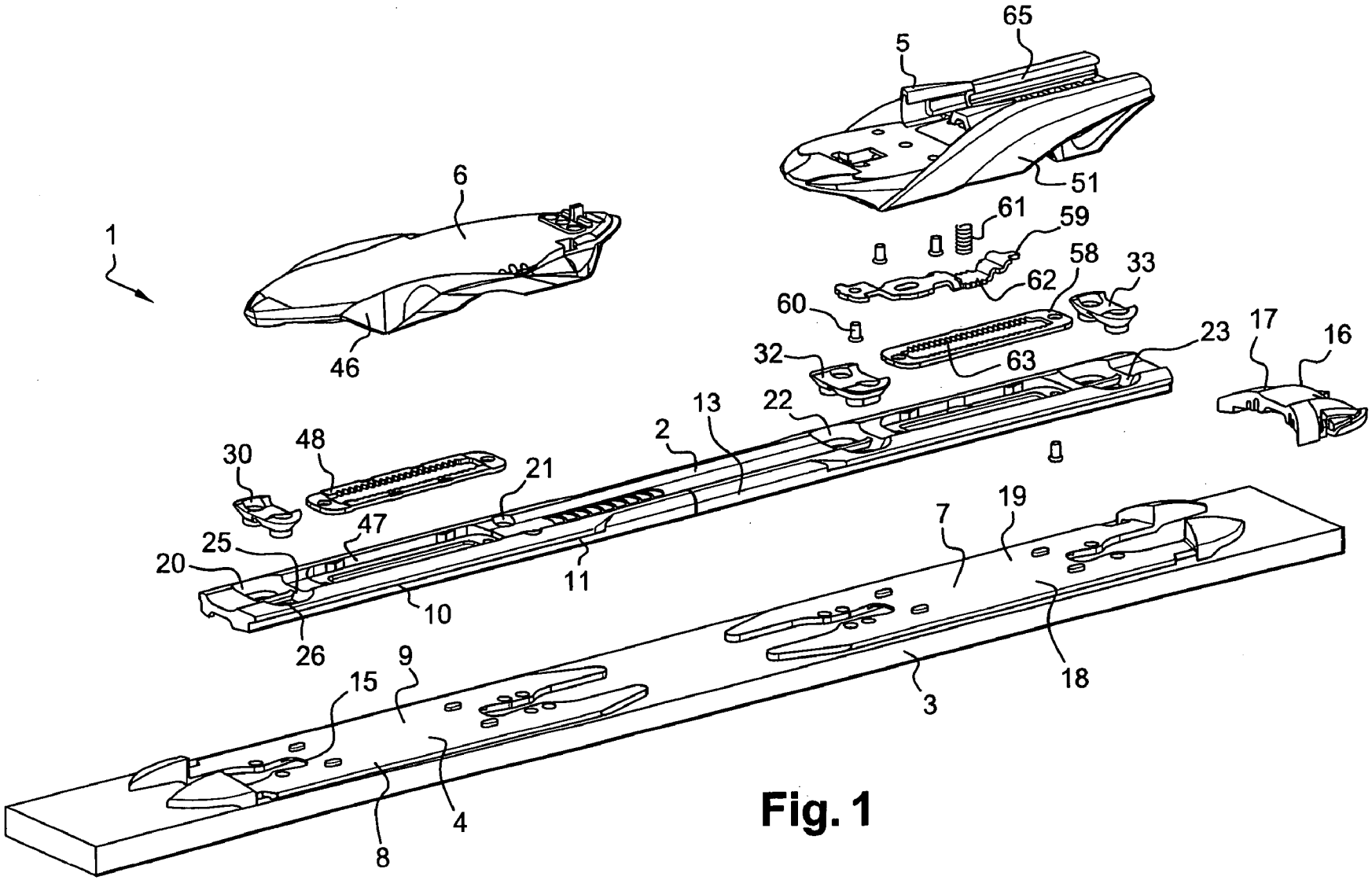
FIG. 1 is a simplified exploded perspective view of the various components that make up a device according to the invention.

As shown in FIG. 1, the device according to the invention comprises various components, namely a strip (2) intended to be mounted on the upper surface of the ski (3) and resting on a base (4, 7) so as to accommodate a rear unit (5) capable of accommodating the heel piece of the binding (not shown) and a front unit (6) capable of accommodating the toe piece of the binding (not shown).

More precisely, the longitudinal strip (2) is in the form of an element based on a metal section, for example, that is subsequently machined or even a moulding, for example, made of filled plastic in order to give it a certain amount of rigidity.

This longitudinal strip (2) has lateral guides that, in the form shown, consist of rails (10) that define a groove (11) between the upper surface of the ski (3) and said rail into which the protruding elements on the inside surface of units (5, 6) engage.

There is a break in this guide (10) in the middle of the platform in order to define a recess (13) intended to make it possible to fit units (5, 6).

In the form illustrated, strip (2) rests on a base consisting of two pads (4, 7). These pads (4, 7) can be made of a rigid material in order to improve the transmission of vertical forces. They can also be made of a viscoelastic material in order to partially damp movement of the longitudinal strip relative to the upper surface of the ski.

In the form shown, this base consists of two separate pads, one of which accommodates the front and one of which accommodates the rear of strip (2). More precisely, each pad (4, 7) has a middle portion (15) of reduced thickness. This portion (15) is used to mechanically join the two lateral parts of the pad (4, 7) which receive contact surfaces of the strip (2) in order to facilitate handling of the pad during assembly. This portion (15) is not in contact with the upper surface of the ski and pad (4, 7) only comes into contact with the upper surface of the ski through the two lateral areas (8, 9, 18, 19) in order to ensure that forces are transmitted directly onto the edges.

Nevertheless, the invention also covers variants in which these two pads are assembled and form a single piece. Other variants can also be envisaged in which the base is formed by two pads separated by a longitudinal gap, each pad receiving the contact surfaces from one side of the platform. It is also possible to have a base comprising four pads by combining both these variants.

In the form shown, the pads that form the base have, on their front ends, protruding areas intended to be accommodated by part (16), the rear part (17) of which is elastic or even viscoelastic. Viscoelastic part (17) is compressed by the rear end of the strip when the latter moves due to bending of the ski.

Figure 2:
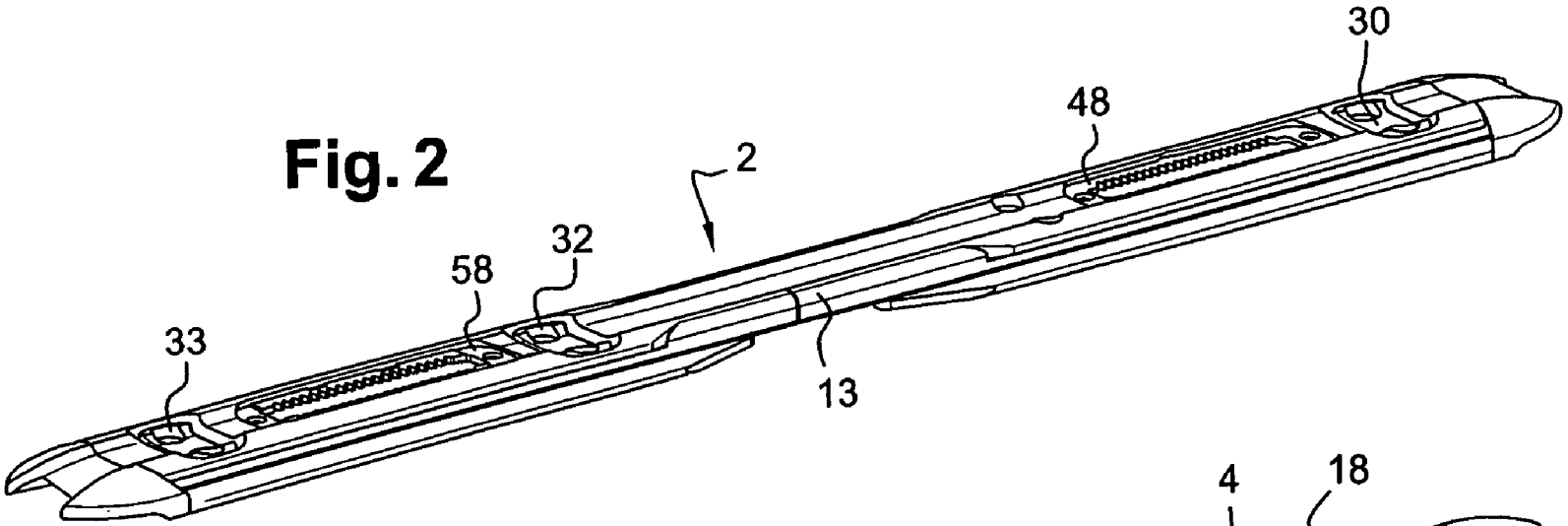
FIG. 2 is a simplified perspective view of the platform and the associated corresponding base, viewed from above.
Figure 3:
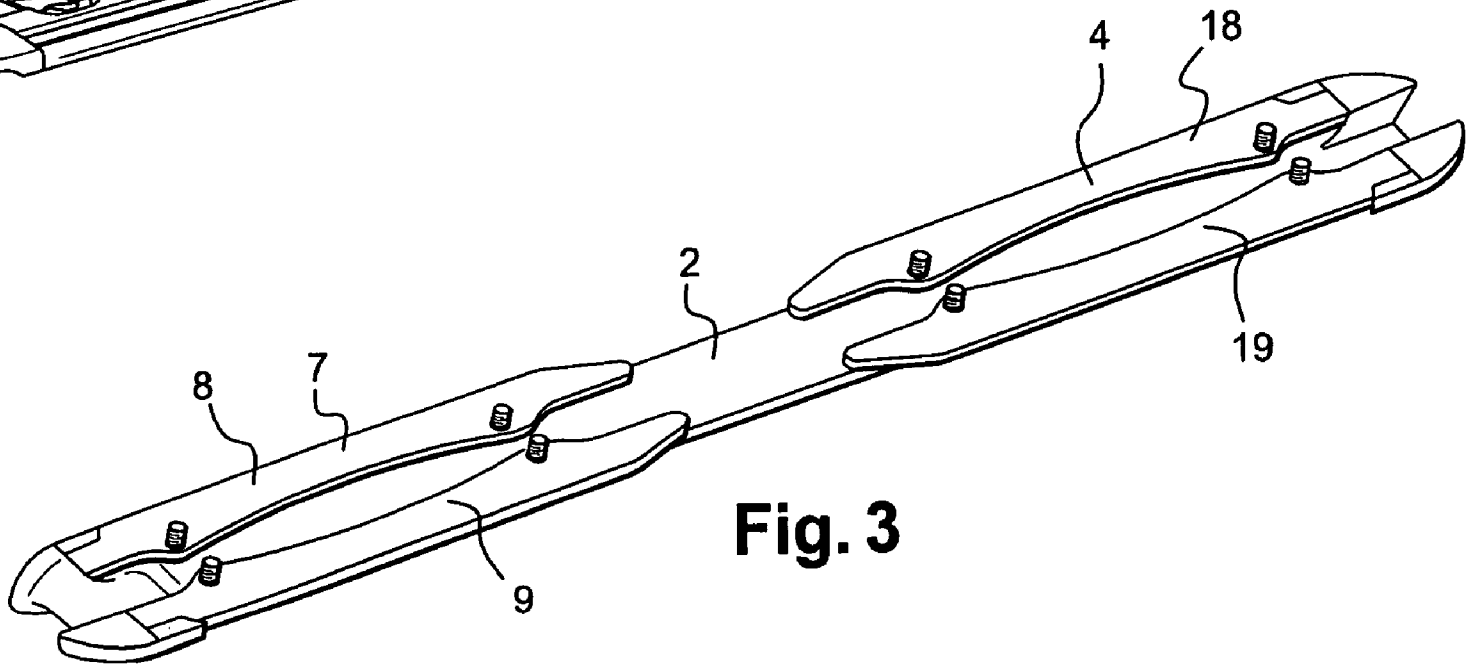
FIG. 3 is a simplified perspective view of the assembly in FIG. 2, viewed from below.

As shown in FIGS. 2 and 3, the base formed by pads (4, 7) extends laterally over a width that exceeds that of the strip (2) in order to improve the lateral stability of the assembly and the transmission of vertical forces towards the edges.

Figure 4:
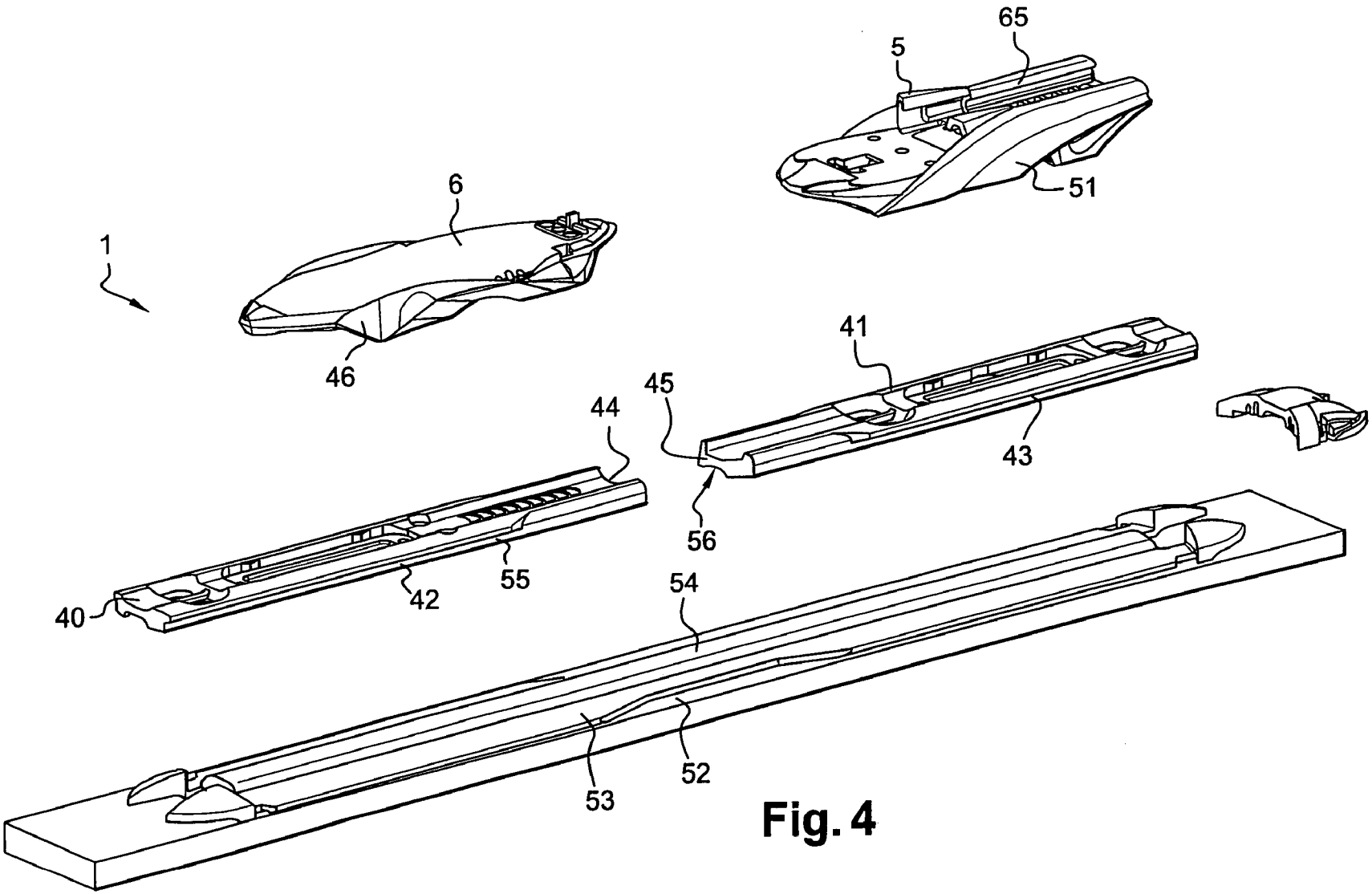
FIG. 4 is a view similar to FIG. 1, showing another embodiment.

In the embodiment shown in FIG. 4, the strip comprises two distinct portions (40, 41) which are each designed to accommodate a unit (5, 6) on which a component of a binding (not shown) will be mounted. More precisely, the front (40) and rear (41) portions of the strip each comprise a part of the guide (42, 43) delimited in the same way as for the strip described above. The two sections of the guide (42, 43) are arranged in line with each other on the same side of the strip. In the form shown, the guide (43) of the rear portion of the strip (41) is interrupted before the front end (45) of this portion (41). The same construction can be adopted for the rear end (44) of the front portion (40) of the strip with a guide (42) that starts just before the rear terminal area (44) of portion (40) of the strip. This creates sufficient space to make it possible to fit units (5, 6) when the binding is mounted. The base (53) that supports the strip also has a waisted section (52) underneath the area where the units that accommodate the binding are fitted.

In the form shown in FIG. 4, the two portions (40, 41) of the strip are arranged on a central rail (54) formed along the longitudinal centre line of base (53). These two portions (40, 41) sit astride this rail (53) thanks to a central channel (56) which allows good lateral positioning when the assembly is mounted on the ski.

In FIG. 1, strip (2) is fixed on the ski at several mounting points on different parts along the length of the ski. More precisely, mounting takes place in four distinct areas (20, 21, 22, 23). Mounting in the intermediate area (21) allows no freedom to slide because of screws that pass through holes having the same diameter as the screws.

As far as the other three mounting areas (20, 22, 23) are concerned, a through recess is made in the strip. This recess comprises an upper portion (25), the faces of which slope and a lower part that opens out onto the lower surface of the strip (2). These through-openings are substantially longitudinally elongated (26). These recesses (20, 22, 23) are intended to accommodate two different types of mounts (30, 32, 33) that are shown in more detail in FIGS. 4 to 7.

Figure 5:
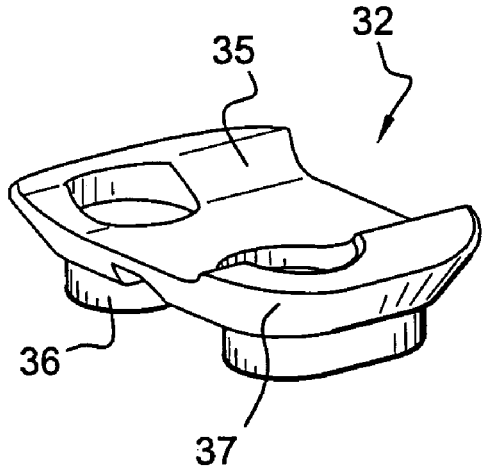
FIGS. 5 and 6 are simplified perspective views of the top and the bottom respectively of a first type of component that ensures mounting of the device on the ski.
Figure 6:
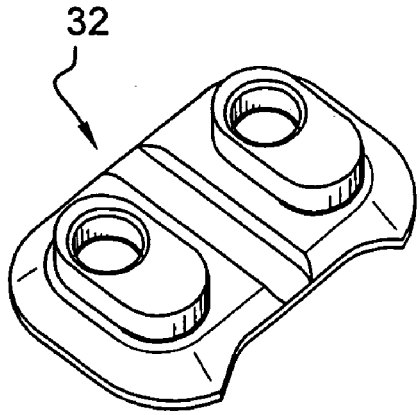

As shown in FIGS. 5 and 6, mount (32) has an upper part (35) that flares upwards and has the same volume as the upper part (25) of recess (20). The lower part of the bottom (36) of mount (32) also has a volume that is substantially identical, with slight clearance, to the through-opening (26) of recess (20).

In this way, when mount (32) is fitted in recess (22), the sloping faces (37) of mount (32) come into contact with the sloping faces of recess (22) and therefore ensure that the area of the strip in which it is fitted is locked in position.

Figure 7:
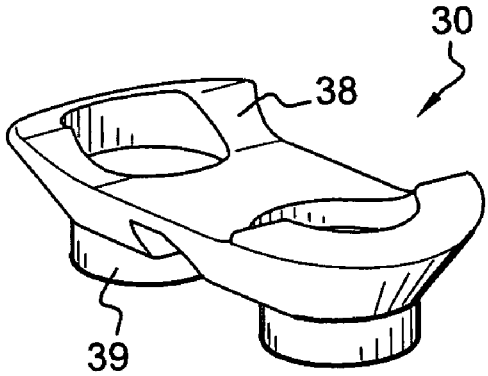
FIGS. 7 and 8 are views similar to FIGS. 5 and 6 of a second type of mounting component.
Figure 8:
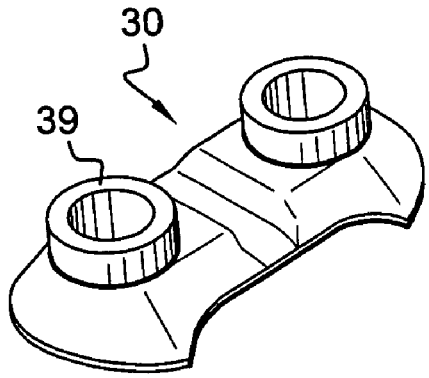

Conversely, mount (30) shown in FIGS. 7 and 8 has smaller dimensions. The upper part (38) also has sloping faces but the overall volume of upper part (38) is less than that of recess (20).

Additionally, the studs (39) that form the lower part of mount (30) also have a diameter that is less than the longitudinal dimensions of openings (26) in recess (20). In this way, the mounting point constituted by mount (30) prevents any sideways or vertical movement of the area of strip (2) in which it is installed. In contrast, there is freedom to move longitudinally and this is exploited during bending of the ski.

The upper part of strip (2) is intended to receive the two units (5, 6) designed to accommodate the heel piece and toe piece respectively of the binding (these are not shown). To achieve this, front unit (6) has an upper surface that is substantially flat with holes for mounting the toe piece. Unit (6) has lateral portions (46), the inside faces of which have features intended to cooperate with the guide or rail (10) of strip (2). These features extend over a length that is less than the length of recess (13) in order to make it possible to install the unit and, if applicable, remove it.

The upper surface of strip (2) comprises a recess (47) intended to accommodate a notched plate (48). This plate (48) cooperates with a mechanism that is not shown but protrudes underneath the lower surface of front unit (6) so as to allow adjustment of the longitudinal position of unit (6) after sliding it along strip (2).

Additionally, rear unit (5) also comprises portions (51) that extend laterally and, on their inside surfaces, have features that allow sliding in guide (10). The same adjustment mechanism system using a notched plate (58) can be used.

More precisely, the mechanism underneath unit (5) consists of a flexible plate (59) attached underneath unit (5) by a rivet (60) and held in a downward position by a spring (61). In this way, the lateral notches (62) of this plate (59) cooperate with the notches (63) on plate (58). A force exerted on the rear part of plate (59) raises it and ensures release of the notched areas (62, 63).

In the form shown, unit (5) comprises, on its upper surface, an additional guide that can accommodate the moving part of the heel piece. Nevertheless, the invention also covers variants in which the entire heel piece is screw fastened onto a substantially flat rear unit.

The device according to the invention combines the following advantages:

- wide variety of options of adjusting the stiffness of the ski by locking the strip on the board in different modes;
- wide variety of options of transmitting forces onto the ski by choosing the shape of the base
- extremely easy to install;
- the ability to adjust the position of each component of the binding;
- good thrust transfer.

The invention claimed is:

1. A device (1) for mounting the components of a safety binding on a ski, comprising:

a longitudinal strip (2) that has, on either side, a guide (10) with a break in its middle;

two units (5, 6) each intended to accommodate one of the components of the safety binding, each unit being mounted on said strip (2) with the possibility of adjusting its longitudinal position by sliding in said guides (10) a plurality of points (20-23) for mounting the longitudinal strip (2) on the upper surface of the ski, some of these points (20, 23) allowing longitudinal displacement, relative to the upper surface of the ski, of the area of the longitudinal strip in which they are located;

a base (4, 7) intended to come into contact with the upper surface of the ski and on which said longitudinal strip (2) rests, said base extending over a width in excess of that of said longitudinal strip.

2. A device as claimed in claim 1, characterised in that the guide is formed by a groove on the lateral surface of the longitudinal strip.

3. A device as claimed in claim 1, characterised in that the guide is formed by a rail (10) on the lateral surface of the longitudinal strip (2).

4. A device as claimed in claim 1, characterised in that the strip (2) is of one-piece construction.

5. A device as claimed in claim 1, characterised in that the strip is formed from two separate pieces, namely a front piece (40) and a rear piece (41) that are separated where there is the break in the guide (42, 43).

6. A device as claimed in claim 1, characterised in that the longitudinal strip (2) has an area of reduced flexural stiffness in its middle.

7. A device as claimed in claim 1, characterised in that the longitudinal position of each unit (5, 6) can be adjusted through cooperation of a mechanism (59) on the unit and notched features (58) on the longitudinal strip.

8. A device as claimed in claim 1, characterised in that some of mounting points (20, 23) are formed by longitudinally elongated holes through which components (30, 33) having a smaller cross-section pass.

9. A device as claimed in claim 1, characterised in that mounting points (20-23) are arranged at four distinct longitudinal levels.

10. A device as claimed in claim 1, characterised in that the base (4, 7) is made of an elastic material.

11. A device as claimed in claim 1, characterised in that the base is formed by at least two longitudinally separated pads.

12. A device as claimed in claim 1, characterised in that the base is formed by at least two transversely separated pads (4, 7).

13. A device (1) for mounting the components of a safety binding on a ski, comprising:

a longitudinal strip (2) that has two opposed ends and, on either side, a guide (10) with a break in its middle;

two units (5, 6) each intended to accommodate one of the components of the safety binding, each unit being mounted on said strip (2) with the possibility of adjusting its longitudinal position by sliding in said guides (10);

a plurality of points (20-23) for mounting the longitudinal strip (2) on the upper surface of the ski, some of these points (20, 23) allowing longitudinal displacement, relative to the upper surface of the ski, of the area of the longitudinal strip in which they are located;

a base (4, 7) intended to come into contact with the upper surface of the ski and on which said longitudinal strip (2) rests, said base extending over a width in excess of that of said longitudinal strip, wherein: said base comprises two separate pads, each of which accommodates a respective end of said strip; and each of said pads has two lateral parts separated by a middle portion of reduced thickness that does not contact the upper surface of the ski, or by a longitudinal gap, so that forces on said units are transmitted directly onto the edges of the ski.

* * * * *